United States Patent [19]

Seitmann

[11] 4,294,019

[45] Oct. 13, 1981

[54] GRAIN DRYING APPARATUS

[76] Inventor: Vernon H. Seitmann, Laurel, Iowa 50141

[21] Appl. No.: 36,382

[22] Filed: May 7, 1979

[51] Int. Cl.[3] ..... F26B 9/02

[52] U.S. Cl. ..... 34/65; 34/167; 34/168; 34/172; 34/231; 414/268; 34/211

[58] Field of Search ..... 414/147, 268; 52/234, 52/192; 34/211, 65, 225, 66, 231, 181, 167, 172, 168

[56] References Cited

U.S. PATENT DOCUMENTS

| | | | |
|---|---|---|---|
| 2,342,528 | 2/1944 | Carbaugh | 414/268 |
| 3,111,399 | 11/1963 | Trom | 34/233 |
| 3,416,239 | 12/1968 | Louks | 34/211 |
| 3,624,921 | 12/1971 | Easton | 234/211 |
| 3,849,901 | 11/1974 | Sietmann et al. | 34/52 |
| 4,035,928 | 7/1977 | Sietmann et al. | 34/52 |

*Primary Examiner*—Larry I. Schwartz

*Attorney, Agent, or Firm*—Zarley, McKee, Thomte, Voorhees & Sease

[57] ABSTRACT

A grain drying apparatus includes an upright bin having a perforated drying floor supported substantially above a perforated cooling floor. An opening through the drying floor communicates with a hopper having a gate mechanism adapted to confine grain within the hopper when closed and adapted to permit grain to fall from the hopper into the cooling chamber when opened. A grain discharge conveyor has one end in communication with the hopper and the other end extended outwardly through the bin sidewall. A support truss for the drying floor includes upper and lower ring members supported in vertically spaced-apart and aligned relation, a plurality of purlins radiating outwardly from the upper ring member for connection to the bin sidewall at circumferentially spaced positions and a plurality of tension braces radiating outwardly from the lower ring member for connection to the purlins adjacent the bin sidewall.

16 Claims, 5 Drawing Figures

GRAIN DRYING APPARATUS

BACKGROUND OF THE INVENTION

The present invention is directed generally to an improved apparatus for drying grain and the like and more particularly to a grain bin having an elevated perforated drying floor with an opening in communication with a hopper which may be closed to confine grain in communication with one end of a discharge auger or opened to permit grain to fall onto the cooling floor below.

All of the known prior art grain drying apparatus which employ an elevated perforated cooling floor having certain problems associated with them relating to the efficiency of energy utilization during the drying process. One such problem is the removal of dried grain from the bin. In the prior devices, the grain on the drying floor had to be transferred onto the lower cooling floor whereupon the grain must be lifted again by an auger or elevator for transfer to a truck, another bin or the like. Another problem with known grain dryers is the inefficient utilization of thermal energy for drying the grain therein. Finally, an improved means for supporting an elevated drying floor within an upright cylindrical bin is needed.

SUMMARY OF THE INVENTION

The grain drying apparatus of the present invention includes a grain bin having a perforated cooling floor supported in the bin above the bottom surface to define an ambient air supply chamber between the bottom surface and cooling floor. A perforated drying floor is supported substantially above the cooling floor to define a cooling chamber between the cooling floor and drying floor and a drying chamber between the drying floor and bin top wall. The bin top wall has an opening for the introduction of grain into the drying chamber and the drying floor has an opening in communication with a hopper supported below the drying floor, said hopper having a gate means adapted to confine grain within the hopper when closed and adapted to permit grain to fall from the hopper into the cooling chamber when opened. A grain discharge conveyor has one end in communication with the hopper and the other end extended outwardly through the bin sidewall whereby when the hopper gate means is closed, grain may be horizontally conveyed through the hopper and discharge conveyor exteriorly of the bin without any lifting of the grain. Thus mechanical energy is conserved.

A heater fan introduces warm dry air into the bin below the perforated drying floor and another fan forces ambient air into the ambient air supply chamber whereby the ambient air is warmed as it passes upwardly through grain on the cooling floor and then mixed with the warm dry air to dry grain supported on the drying floor. Accordingly, thermal energy is recycled from the previous batch of dried grain to dry the subsequent batch of grain introduced onto the drying floor.

The drying floor support apparatus utilizes a pair of vertically spaced-apart and aligned ring members with purlins radiating outwardly from the upper ring member and tension braces radiating outwardly from the lower ring member for connection to the purlins adjacent the bin sidewall whereby the combination of the ring members, purlins and tension braces provide a plurality of trusses which coact to rigidly support the perforated drying floor at an elevated position in a cylindrical drying bin.

DESCRIPTION OF THE PREFERRED EMBODIMENT

Figure 1:
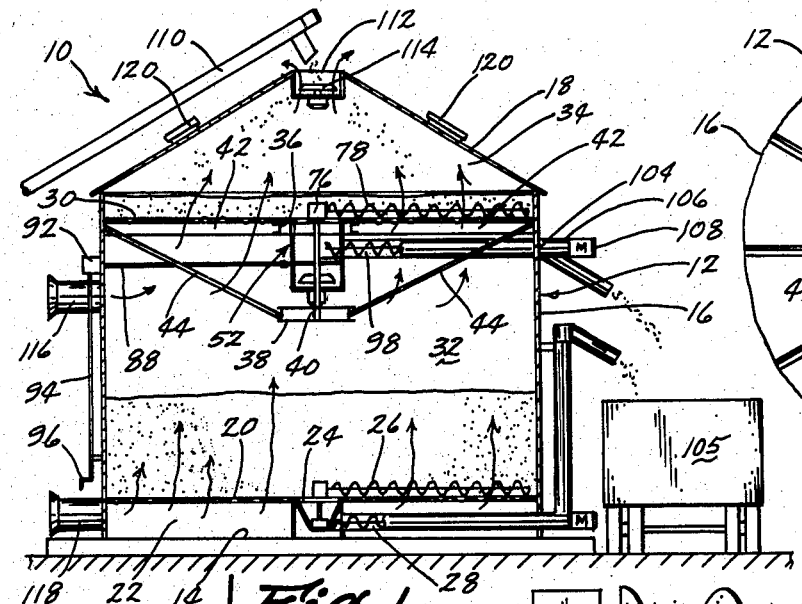
FIG. 1 is a side sectional view of the grain drying apparatus of the invention.

The grain drying apparatus 10 of the present invention is shown in FIG. 1 as including an upright cylindrical grain bin 12 having a bottom surface 14 such as a concrete pad or the like, a continuous sidewall 16 and a somewhat conical top wall 18. A perforated cooling floor 20 is supported in the bin in spaced relation from the bottom surface 14 to define an ambient air supply chamber 22 between the bottom surface 14 and cooling floor 20. The cooling floor 20 has a central opening 24 to which grain is conveyed by a sweep auger 26 for conveyance of the grain outwardly of the bin through a discharge auger 28 situated below the cooling floor.

Figure 5:
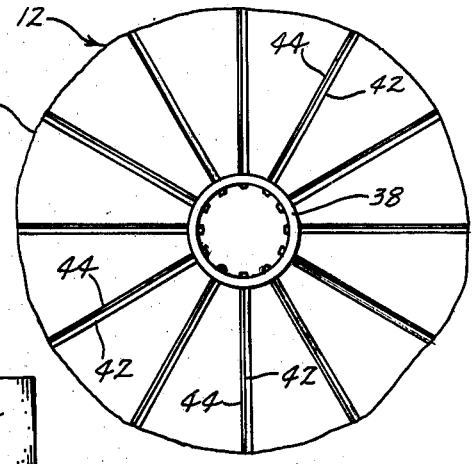
FIG. 5 is a bottom view of the elevated drying floor support truss of the invention.
Figure 2:
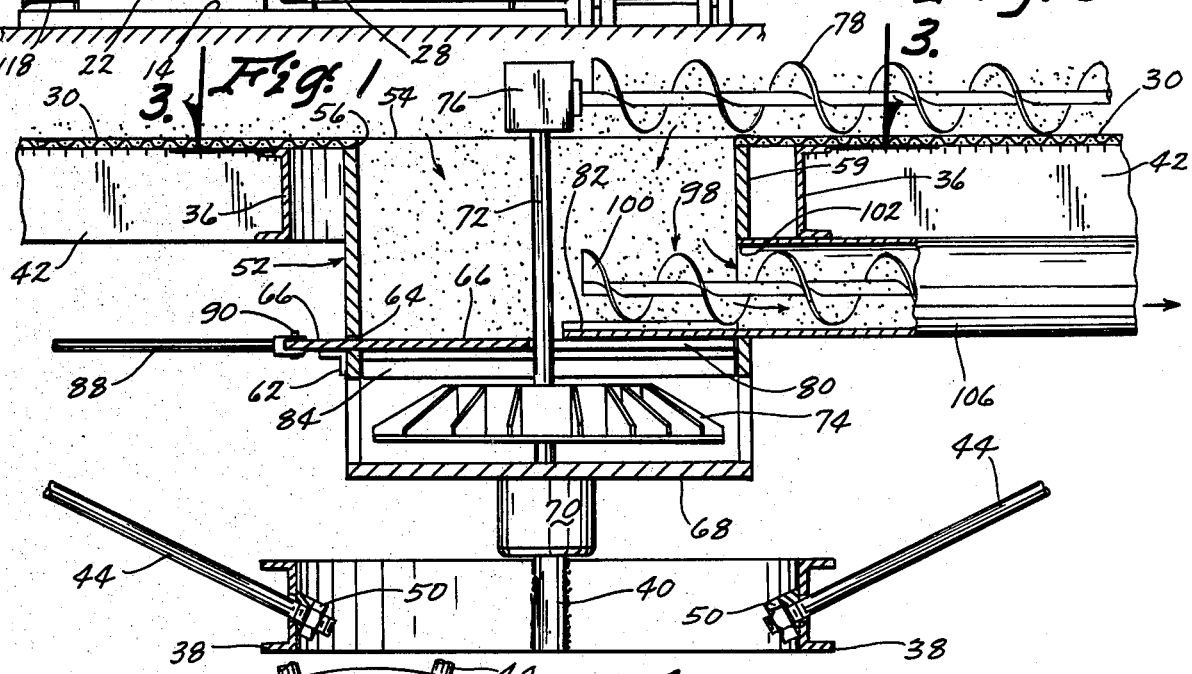
FIG. 2 is an enlarged partially sectional detail view of the hopper supported on the underside of the elevated drying floor.

A perforated drying floor 30 is supported in the bin and spaced substantially above the cooling floor 20 to define a cooling chamber 32 between the cooling floor 20 and drying floor 30 and a drying chamber 34 between the drying floor 30 and top wall 18. The structure for supporting drying floor 30 at an elevated position in the bin includes an upper ring member 36, which is a circular band of channel material, a similar lower ring member 38 and a plurality of vertically disposed angle iron braces 40 which are rigidly secured to the upper and lower ring members to maintain them in vertically spaced-apart and aligned relation. Referring to FIGS. 1 and 5, a plurality of purlins 42 radiate horizontally outwardly from the upper ring member 36 for connection at their opposite ends to the bin sidewall 16 at circumferentially spaced-apart positions thereon. An elongated tension brace 44 is connected to each purlin 42 adajcent the bin sidewall 16 with the opposite ends of the braces 44 secured to the lower ring member 38 so as to coact with the purlins 42, ring members 36 and 38 and upright braces 40 to form a truss for supporting drying floor 30. The rigid connection between rings 36 and 38 by braces 40 enables the ring 38 to substantially bear the load of floor 30 through braces 44. In FIG. 2, the tension braces 44 are shown as elongated round section rods having interior ends 46 extended through circumferentially spaced-apart holes 48 in the lower ring member 38 and threaded to receive nuts 50. The nuts abut against the interior surface of lower ring 38 to prevent withdrawal of the braces 44 from holes 48. The nuts 50 also provide a limited length adjustment capability for the tension braces 44. The drying floor 30 is formed of perforated sheet material supported on the purlins 42.

A grain hopper 52 is supported below the drying floor with its open top end 54 registered with an opening 56 in drying floor 30 for receiving grain therefrom.

Figure 3:
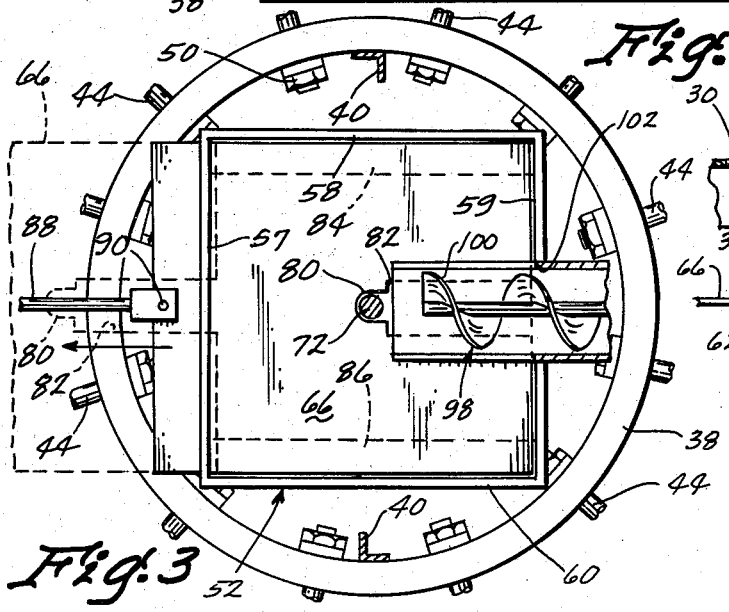
FIG. 3 is a top sectional plan view of the hopper and gate mechanism as seen on line 3—3 in FIG. 2.
Figure 4:
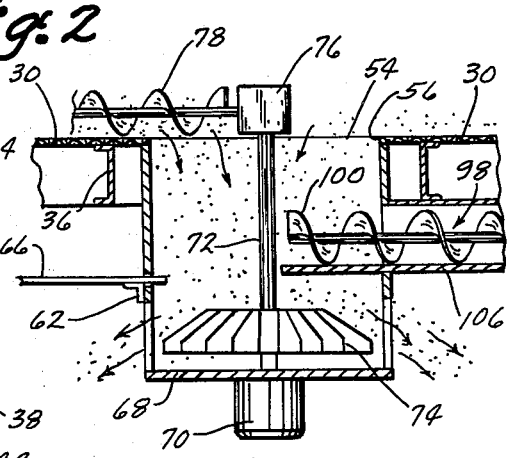
FIG. 4 is a side sectional view, similar to FIG. 2, showing the hopper gate mechanism in an open position.

Referring to FIGS. 2 and 3, grain hopper 52 is shown as a square section sleeve including sidewalls 57, 58, 59 and 60. The four corners of hoppers 52 are secured to the inner permieter of upper ring member 36 such as by welding or the like. A crossbrace 62 is connected to and extended between hopper sidewalls 58 and 60 at a position spaced vertically below the lower edge of sidewall 57 so as to define a slot 64 for slidably receiving a gate 66 as will be described in further detail below. A generally U-shaped frame 68 extends downwardly from crossbrace 62 and sidewall 59 for supporting a motor 70 at a position generally centered relative to the hopper. A motor output shaft 72 extends upwardly through the hopper 52 and carries a centrifugal grain spreader 74 at a position below gate 66. Shaft 72 operates through a gearbox 76 to drive a sweep auger 78 on the perforated drying floor 30.

Gate 66 is shown in FIGS. 2 and 3 as a slide plate having an elongated slot 80 adapted to receive motor shaft 72. A permanent plate 82 extends inwardly from the hopper sidewall 59 to prevent grain from falling through slot 80 when the gate is in its inward or closed position of FIGS. 1–3. Gate 66 is supported on crossbrace 62 and on elongated tracks 84 and 86 secured to hopper sidewalls 58 and 60.

To open and close the gate 66, a linkage 88 is connected to the gate as at 90 and extended outwardly through the bin sidewall to a housing 92. Linkage 88 is operatively connected to a gear mechanism in housing 92 such that the linkage is axially moved in response to rotation of a crank rod 94 by an operator manually turning crank 96. In other embodiments, linkage 88 may be withdrawn and advanced relative to hopper 52 automatically by a motor disposed within housing 92 and remotely controlled by an operator.

A grain discharge conveyor in the form of an auger 98 has one end 100 extended into the hopper 52 through an opening 102 in sidewall 59 and an opposite end 104 extended outwardly of the bin 12 through sidewall 16 for discharging dried grain directly to a truck 105 or the like as shown in FIG. 1. The grain discharge auger 98 is housed within an auger tube 106 which is positioned adjacent to the underside of the drying floor 30. A motor 108 at the exterior end of tube 106 drives the discharge auger 98.

In operation, grain is conveyed by an elevator or auger 110 to an opening 112 in the bin top wall 18, whereupon the grain is distributed by a centrifugal spreader 114 generally uniformly onto the drying floor 30. At this stage, the hopper gate 66 is closed and sweep auger 78 is disposed at rest. A fan and heater unit 116 is then energized to introduce warm dry air into the cooling chamber 32 below drying floor 30 so that the warm dry air will rise through the perforated drying floor and grain supported thereon to dry the same. At the same time, fan unit 118 is energized to introduce ambient air into the ambient air supply chamber 22, thereby to force the warm dry air upwardly and avoid reverse flow. The warm dry air may preferably be maintained at approximately 150° F. and 1.5 inches static pressure. As the air passes upwardly, it picks up moisture from the grain on drying floor 30 and is exhausted through vents 120 in top wall 18.

When the grain reaches the desired dryness, fan and heater unit 116 is de-energized, hopper gate 66 is moved to its dotted line open position of FIG. 3 and grain falls through the hopper onto spreader 74 for even distribution onto the cooling floor 20 where it will be cooled by cooling fan 118. Hopper gate 66 is then closed and a new batch of moist grain may be introduced into the drying chamber to repeat the process. It will be apparent that the ambient air from cooling fan 118 is warmed as it passes upwardly through the grain on cooling floor 20. This air mixes with the warm dry air from fan and heater unit 116 to dry the next batch of grain on drying floor 30. Thus heat energy is recycled.

In the event that it is desired to dry grain in the apparatus 10 of the invention but not store the grain in cooling chamber 32, the dried grain may be unloaded from the drying floor 30 to an outside location such as truck 105 by activating the discharge auger 98 simultaneously with sweep auger 78 while maintaining gate 66 in the closed position of FIG. 2. Since no lifting of the grain is required, all vertical movement is accomplished by gravity for a resultant saving of mechanical energy.

The apparatus 10 is ideally suited for drying relatively thin layers of grain, as indicated on drying floor 30 in FIG. 1. Accordingly, higher volumes of air may be pushed through the grain as compared to conventional dryers and thus lower temperature air may be used which increases the quality of grain and reduces fuel costs.

I claim:

1. An apparatus for drying grain comprising,
a grain bin having a bottom surface, sidewall and top wall,
a perforated cooling floor supported in said bin in spaced relation from said bottom surface to define an ambient air supply chamber between said bottom surface and cooling floor,
a perforated drying floor supported in said bin and spaced substantially above said cooling floor to define a cooling chamber between said cooling floor and drying floor and a drying chamber between said drying floor and top wall,
said top wall having an opening for the introduction of grain into said drying chamber and said drying floor having an opening therethrough,
a grain hopper supported below said drying floor in communication with said drying floor opening,
a grain discharge conveyor having one end in communication with said hopper and the other end extended outwardly through said sidewall,
said hopper including a gate means adapted to confine grain within said hopper when closed and adapted to permit grain to fall from the hopper into the cooling chamber when opened,
a sweep auger positioned on said drying floor and operative to traverse said drying floor for conveying grain to said hopper through said drying floor opening,
a grain spreader means positioned below said gate means for distributing grain generally uniformly about said cooling chamber, and
a single power means for operating said sweep auger and said grain spreader means.

2. The apparatus of claim 1 wherein said grain discharge conveyor comprises an elongated auger rotatably supported within an auger tube.

3. The apparatus of claim 2 wherein said auger extends into said hopper.

4. The apparatus of claim 2 wherein said auger tube is positioned adjacent the underside of said drying floor.

5. The apparatus of claim 1 further comprising means for introducing warm dry air into said cooling chamber below said drying floor for said warm dry air to rise through said drying floor to dry grain supported thereon, and means for introducing ambient air into said ambient air supply chamber to force said ambient air upwardly through said cooling floor to cool grain supported thereon whereby ambient air, warmed by grain supported on the cooling floor, mixes with said warm dry air to dry grain supported on said drying floor.

6. The apparatus of claim 1 further comprising a sweep auger operatively positioned on said cooling floor and a discharge auger positioned below said cooling floor for conveying grain received from said sweep auger outwardly of the bin.

7. The apparatus of claim 1 further comprising a grain spreader means associated with said top wall opening for distributing grain generally uniformly about said drying chamber.

8. The apparatus of claim 1 wherein said single power means comprises an electric motor, and further comprising means for supporting said electric motor below said hopper, a motor output shaft extending upwardly from said motor through said hopper for operatively driving said sweep auger on said drying floor, said grain spreader means being carried on said motor output shaft for rotation therewith.

9. In an upright generally cylindrical grain bin, an apparatus for supporting an elevated floor structure comprising, an upper rigid ring member, a lower rigid ring member, means for securing said upper and lower ring members in vertically spaced-apart and aligned relation, a plurality of generally horizontal purlins connected at one end to said upper ring member and connected at the other end to said sidewall at circumferentially spaced-apart locations thereon, and a plurality of tension braces, each operatively connected at one end to said lower ring and operatively connected at the opposite end to a respective purlin adjacent the bin sidewall.

10. The apparatus of claim 12 wherein said lower ring has a plurality of circumferentially spaced-apart holes therethrough and said tension braces extend through said openings and have abutment means engageable with the interior surface of said lower ring to prevent the withdrawal of said braces from said openings.

11. The apparatus of claim 10 wherein said tension braces comprise elongated tubular members.

12. The apparatus of claim 9 wherein said purlins are radially directed with respect to the center of said upper ring member.

13. The apparatus of claim 9 wherein each tension brace is arranged generally radially parallel to the purlin to which it is connected.

14. An apparatus for drying grain comprising a grain bin having a bottom surface, sidewall and top wall, a perforated cooling floor supported in said bin in spaced relation from said bottom surface to define an ambient air supply chamber between said bottom surface and cooling floor, a perforated drying floor supported in said bin and spaced substantially above said cooling floor to define a cooling chamber between said cooling floor and drying floor and a drying chamber between said drying floor and top wall, said top wall having an opening for the introduction of grain into said drying chamber and said drying floor having an opening therethrough, a grain hopper supported below said drying floor in communication with said drying floor opening, a grain discharge conveyor having one end in communication with said hopper and the other end extended outwardly through said sidewall, said hopper including a gate means adapted to confine grain within said hopper when closed and adapted to permit grain to fall from the hopper into the cooling chamber when opened, said grain bin comprising an upright generally cylindrical bin and further comprising a support apparatus for said perforated drying floor including an upper rigid ring member, a lower rigid ring member, means for securing said upper and lower ring members in vertically spaced-apart and aligned relation, a plurality of generally horizontal purlins connected at one end to said upper ring member and connected at the other end to said sidewall at circumferentially spaced-apart locations thereon, and a plurality of tension braces, each operatively connected at one end to said lower ring and operatively connected at the opposite end to a respective purlin adjacent the bin sidewall.

15. The apparatus of claim 8 wherein said gate means comprises a slide plate, and further comprising means for slidably moving said slide plate inwardly of said hopper to a closed position and outwardly of said hopper to an open position, said slide plate having an elongated slot adapted to receive said motor output shaft.

16. The apparatus of claim 14 wherein said drying floor opening is registered with said upper ring member and said hopper is positioned between said upper and lower ring members.

* * * * *